United States Patent [19]

Holmberg

[11] Patent Number: 4,690,585

[45] Date of Patent: Sep. 1, 1987

[54] EROSION CONTROL FOUNDATION MAT AND METHOD

[76] Inventor: Dick L. Holmberg, P.O. Box 100, Whitehall, Mich. 49461

[21] Appl. No.: 692,211

[22] Filed: Jan. 17, 1985

[51] Int. Cl.[4] ..... E02B 3/04; E02B 3/12

[52] U.S. Cl. ..... 405/19; 405/15; 405/17; 405/18

[58] Field of Search ..... 405/15–21, 405/23, 25, 30–35, 172, 24; 47/9

[56] References Cited

U.S. PATENT DOCUMENTS

| | | | |
|---|---|---|---|
| 752,637 | 2/1904 | Markedick | 405/15 |
| 984,121 | 2/1911 | Condie . | |
| 1,039,579 | 9/1912 | Neames | 405/19 |
| 1,253,209 | 1/1918 | Chenoweth . | |
| 2,570,271 | 10/1951 | Pickett . | |
| 3,205,619 | 9/1965 | Henry . | |
| 3,315,408 | 4/1967 | Fisher . | |
| 3,344,609 | 10/1967 | Greiser | 405/20 X |
| 3,396,542 | 8/1968 | Lamberton | 405/18 |
| 3,425,227 | 2/1969 | Hiller . | |
| 3,425,228 | 2/1969 | Lamberton . | |
| 3,474,626 | 10/1969 | Colle . | |
| 3,561,219 | 2/1971 | Nishizawa et al. | 405/19 |
| 3,696,623 | 10/1972 | Heine et al. | 405/19 |
| 3,769,747 | 11/1973 | Chapman . | |
| 3,786,640 | 1/1974 | Turzillo . | |
| 3,862,876 | 1/1975 | Graves . | |
| 3,871,182 | 3/1975 | Estruco . | |
| 3,874,177 | 4/1975 | De Winter | 405/19 |
| 3,957,098 | 5/1976 | Hepworth et al. . | |
| 4,135,843 | 1/1979 | Umemoto et al. | 405/18 |
| 4,184,788 | 1/1980 | Colle | 405/19 |
| 4,405,257 | 9/1983 | Nielsen | 405/19 |
| 4,420,275 | 12/1983 | Ruser | 405/18 X |
| 4,449,847 | 5/1984 | Scales et al. | 405/19 |

FOREIGN PATENT DOCUMENTS

| | | | |
|---|---|---|---|
| 894,675 | 4/1962 | United Kingdom | 405/19 |

*Primary Examiner*—Dennis L. Taylor
*Assistant Examiner*—Nancy J. Stodola
*Attorney, Agent, or Firm*—Price, Heneveld, Cooper, DeWitt & Litton

[57] ABSTRACT

An erosion control structure and method involves placing a large permeable mat with peripheral weighted pockets around and attached to the mat on the bottom of the water body such that at least a portion of the mat extends into a shallow portion of the water body where currents have a velocity sufficient to erode the bottom. The peripheral pockets are filled with a weighted material, such as sand. Large weighted stabilizers are placed on the mat and positioned in the areas where the currents exceed the erosion velocity such that the stabilizers are below the surface of the water.

50 Claims, 20 Drawing Figures

EROSION CONTROL FOUNDATION MAT AND METHOD

BACKGROUND OF THE INVENTION

This invention relates to erosion control devices and methods adapted to check shoreline erosion to allow beach material to accrete.

In the United States and other countries, miles of beaches are annually subjected to severe erosion which literally washes away beachfront and exposes higher ground and valuable property to wave action. If left unchecked, wave and current action erodes the property and undermines foundations of shoreline buildings and houses causing them to topple into the water.

Erosion of this type has been exacerbated and often created by man-made structures. In one typical situation, a pier or jetty is constructed at a river mouth and extends perpendicular from the shoreline into the water to form a navigation channel into the mouth of the river. Littoral or near shore currents impinge upon the sides of the pier deflecting the currents away from shore. These currents typically carry sand which would otherwise be deposited near shore between naturally occurring sandbars extending parallel to the shore and the beach. However, since the currents are deflected away from shore, the sand is carried out to deep water, robbing the beach area of sand which would otherwise deposit there.

Furthermore, the deflected currents actually wash away protective sandbars. Sandbars are critical to beach protection since they dissipate waves and littoral currents. When sandbars erode, the beachfront in the area of the eroded sandbar is exposed to much stronger currents and waves, causing even more severe beach erosion.

Beachfront property owners often spend tens of thousands of dollars each to construct seawalls or revetments on and parallel to the beach in an attempt to stop such erosion. Such attempts, however, serve only to accelerate erosion. Seawalls and revetments only direct the energy of the waves and currents downwardly to the foundation of the seawall or revetment, which scours sand and rock at the foot of the seawall or revetment structure and which ultimately causes the structure to fall into the water. Such downward scouring also deepens the water in the area and allows sediments to be carried away from the littoral zone, leading to even more severe erosion.

Another approach typically taken to attempt to stop such erosion is to position piles, groins or other such structures perpendicular to shore. Such structures are invariably constructed so that they extend into the water from the beach and upward several feet above the surface of the water. Again, littoral currents running parallel or at acute angles to the beach deflect from these structures and carry sand seaward. Also, the waves associated with them are reflected downwardly in the immediate vicinity of each of these structures, eddying and scouring sand and rock on the foot or base of each structure. This eddying eventually undermines the structure and causes it to topple into the water. There have been attempts to reduce the effects of scouring at the bases of the structures by building structures directly in bedrock. However, such construction is extremely expensive as it requires underwater excavation. Such construction is also almost financially prohibitive, especially for the average property owner, in most of the Great Lakes region for bedrock is covered by as much as several hundred feet of unconsolidated clay, sand and gravel.

In addition to the above problems, the increasing wave height and current velocity in a littoral zone created by these "solutions" leads to other types of erosion and foundation problems. It has recently been observed that the weight of a large wave can force water below it into granular, sandy material along the ocean or lake bottom. As water is forced into the granular material, it provides a lubricating water film between the grains and liquifies sandy material below the waves such that currents, if they have sufficient velocity, will wash the liquified material away, or erosion control devices placed on the material will gradually sink into the liquified material. When the devices sink, of course, they lose whatever effectiveness they may have had.

Finally, all of the described devices ruin the aesthetics and desired recreational characteristics of the beach. Because they cause water to deepen and wave energy to increase, these devices create unsightly, scarp-like erosion formations on the beach above the waterline. The deeper water and the upwardly projecting structures also pose hazards for swimmers.

SUMMARY OF THE INVENTION

According to the broadest aspects of the present invention, peripheral pockets are formed around the periphery of a mat or sheet of permeable fabric. This sheet is positioned on the bottom of a water body such that at least a portion of it extends into a part of the water body where currents have a velocity sufficient to erode the bottom. The peripheral pockets are then filled with a weighted material, such as sand. Finally, weighted stabilizer means are positioned on the sheet such that in the area where the currents exceed the erosion velocity, the stabilizer means are below the surface of the water.

Preferably, where the currents would otherwise exceed the erosion velocity, the weighted stabilizer means are positioned sufficiently far below the surface of the water such that the exceeding currents are forced to move upwardly over the stabilizer means, thereby reducing the velocity of the currents below the erosion velocity. Furthermore, the stabilizer means are positioned such that the waves associated with the currents do not reflect downwardly toward the bottom to scour the bottom.

The permeable mat substantially reduces the capacity of waves to liquify sand or other material beneath the mats as the waves pass over the material. Accordingly, the erosion control structure defined by the mats and the weighted stabilizer means will not sink into the liquified, quicksandlike material created by the waves. However, the fabric is sufficiently permeable such that it will allow gases generated, for example, by microbial activity in the sand to percolate upwardly through the structure instead of allowing the structure to be lifted and toppled by the accumulation of such gases.

The provision of the peripheral weighted pockets around the mat also prevents the mats from being washed away or lifted by the currents. In fact, it has been found that the weighted pockets will actually orient themselves downwardly into a sandy bottom and be completely covered by sand within a relatively short period of time. Therefore, waves and currents cannot undermine the mat structure.

Lastly, because the weighted stabilizer means are positioned below the surface of the water in the areas where currents exceed erosion velocity, the currents and waves will rise over the stabilizer means instead of reflecting away from or downwardly from the stabilizer means. As the currents and waves rise over the stabilizer means, they will dissipate and slow down. They do not cause sand or other material to be carried to deeper water to undermine the erosion control structure. Because the currents can be slowed by the structure, sand will actually deposit between a plurality of such structures positioned parallel to one another, ultimately burying the structures and increasing the beach area.

BRIEF DESCRIPTION OF THE DRAWINGS

FIG. 3D is a cross section taken along the same plane as FIG. 3C, illustrating an injector nozzle inserted into the bag;

FIG. 4 is a detail, top elevational view of a corner of the erosion control mat of the present invention;

FIG. 6B is a cross section taken along the plane of line VIB—VIB of FIG. 5;

DETAILED DESCRIPTION OF THE PREFERRED EMBODIMENT

Figure 1:
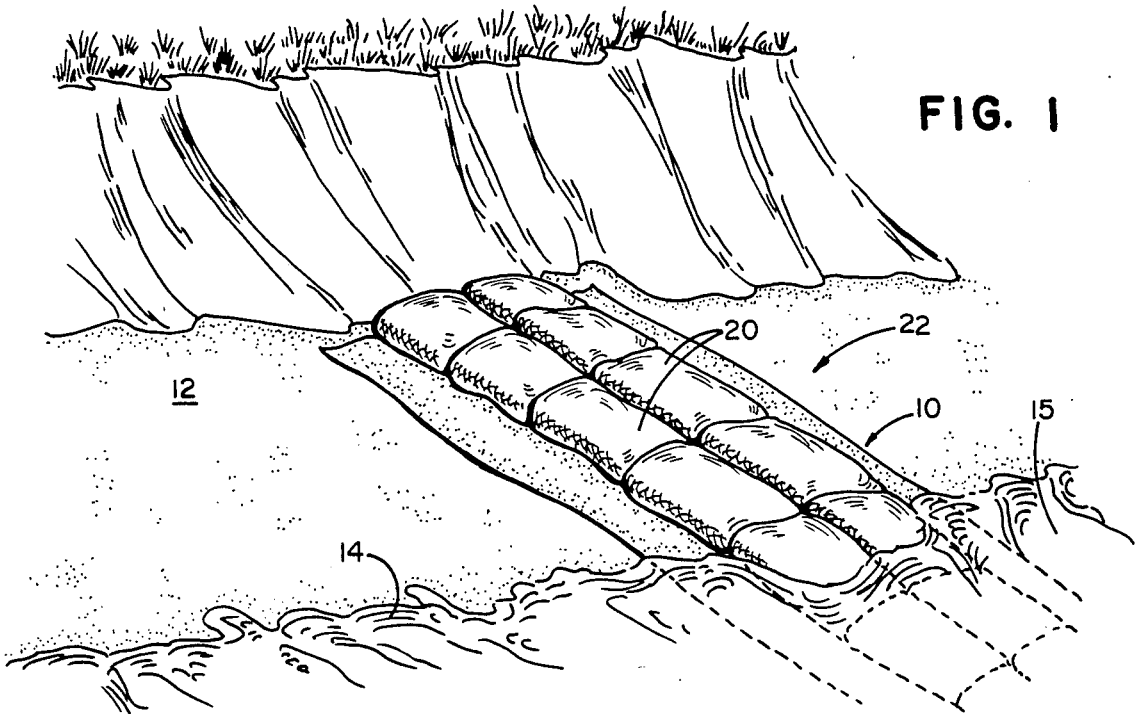
FIG. 1 is a partial persepective view of an erosion control structure of the present invention.

FIGS. 1–4 illustrate the broad aspects of the novel devices of the present invention and their novel uses. As shown in FIGS. 1 and 3A, an elongated rectangular mat or sheet 10 is placed on a beach 12 and extends perpendicularly to the beach into the water 14. Mat 10 extends outwardly into the littoral zone 15 where near shore currents and waves carrying sand can be dissipated. As shown in FIGS. 3A and 5, mat 10 has a peripheral pocket 16 which extends completely around the periphery of mat 10 and is filled with a weighted material, such as sand. When filled with sand, peripheral pocket 16 assumes a downwardly oriented position and buries itself in the sandy bottom 18 of the water body. Even before pocket 16 assumes this position, weighted stabilizers, such as sand-filled bags 20, are placed along the length of the mat and extend into the littoral zone 15 under the water 14. When a plurality of such erosion control structures 22 defined by bags 20 and mats 10 are placed parallel to each other along the beach, the near shore currents in the littoral zone 15 will be dissipated such that they will deposit sand instead of eroding it. The key to this is placing at least a portion of the structures 22 below the water surface in the littoral zone 15 where the current velocity would otherwise be sufficient to entrain or erode sand. The placement of structures 22 in such locations causes eroding currents to rise upwardly over the bags which dissipates the current and wave energy. A plurality of similarly located structures 22 placed parallel to each other will reduce the velocity of such currents to the point where sand will deposit instead of erode. The mats perform the critical function of preventing the waves from liquefying the sand beneath structures 22, preventing the structures 22 from sinking into the sand.

Figure 2:
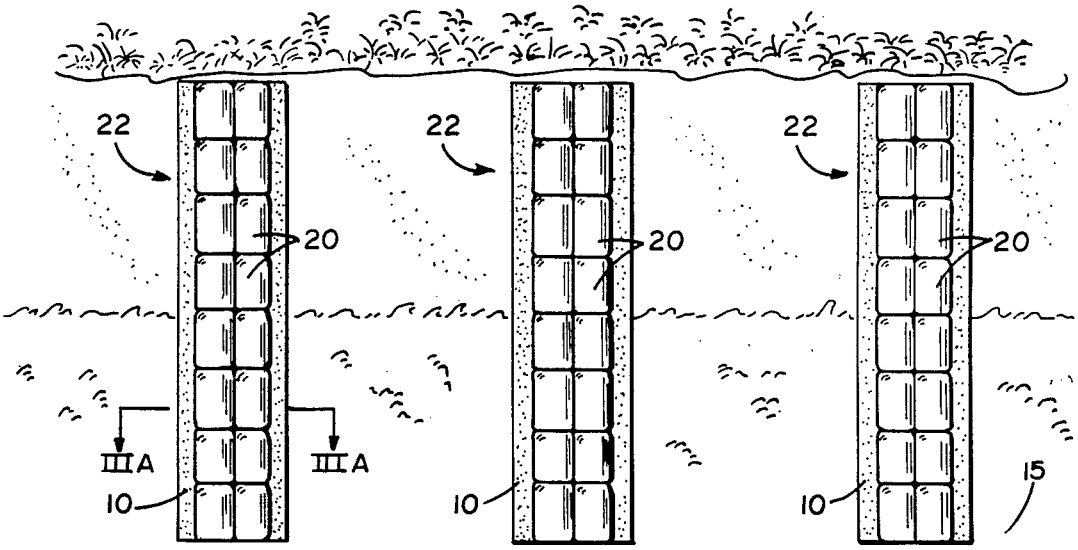
FIG. 2 is a top view of an erosion control system of the present invention.
Figure 5:
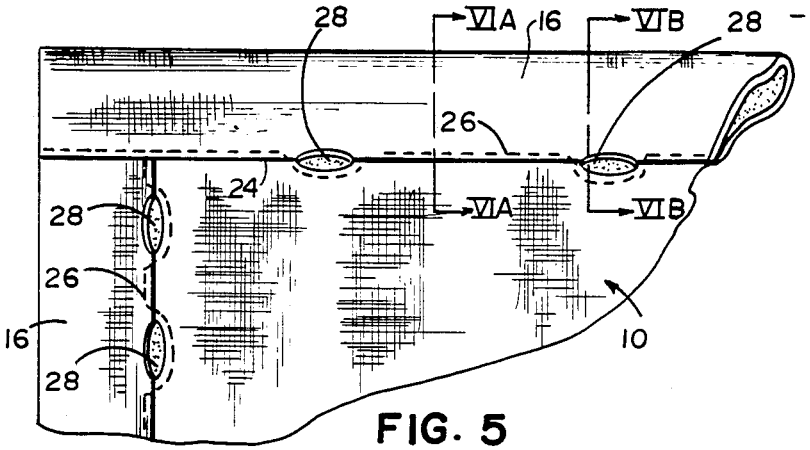
Figure 6A:
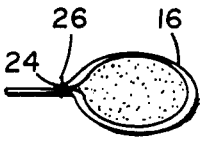
FIG. 6A is a cross section taken along the plane of line VIA—VIA of FIG. 5.
Figure 6A:
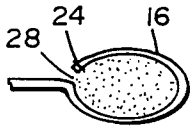

Mat 10, as shown in FIGS. 1, 2 and 5 has peripheral pockets 16 which extend completely around its periphery. Pockets 16 are constructed by folding over the edges 24 of the mat 10 onto the top surface of the mat and stitching or otherwise securing the hem in place by stitches 26 (FIGS. 5 and 6A). As pockets 16 are sewn by stitches 26, unstitched openings 28 (FIGS. 5 and 6B) are left by varying stitches 26 away from the hem in selected, spaced locations to form a plurality of spaced openings 28 along the peripheral pockets 16. Openings 28 should be roughly 8–10 feet apart; each opening 28 is about 6 to 8 inches wide. All of the peripheral pockets 16 are formed by folding the edges of the mat 16 toward one side of the mat, for reasons which will become apparent.

It has been found that when mat 10 is placed on a sandy beach and bottom, openings 28 permit pockets 16 to fill by themselves. In order to do this, mat 10 must be laid upon the beach bottom with openings 28 on the top surface of the mat. As the sand ladened water and wind move sand around the edges of the mat, the sand will move into openings 28 and fill the pockets. In certain circumstances, where a more speedy installation is desired, the pockets can be filled by injecting them with a slurry of sand and water. Injecting the pockets is desirable when bad weather is imminent, for example.

In any event, it is desirable to have the pockets filled with sufficient weighted material such that the pockets contain at least about 90 pounds of weighted material per linear foot of the pockets. To accommodate sufficient material, the pockets should be about 12 inches in diameter when completely filled with sand. A pocket having a 12-inch diameter when filled will provide at least about 90 pounds per linear foot of weighted material in the peripheral pockets. These dimensions are for mats ranging from 5 feet wide by 7 feet long to 40 feet wide by 1000 feet long. Pockets having a larger diameter when full might be desirable for mats exceeding 40 feet by 1000 feet.

It is also possible to fill the peripheral pockets with concrete. However, it is preferable to use sand if it is available on site, because it keeps the peripheral pockets flexible throughout the life of the system and allows the mat to conform to any changes in bottom topography. Sand can be pumped by injecting water into the sand on the lake or ocean bottom to liquify the sand and pumping the liquified sand into the pockets.

Mat 10 is permeable and can be made of either a woven or nonwoven fabric. Geotextile fabrics, such as those sold by Phillips Fibers Corporation under the mark SUPAC, have been successfully employed. The porosity of the fabric should be sufficient such that any granular material below the mat will not work its way through the mat. In addition, the porosity should be such that the penetration of water into the sand created by the waves is between 3 and 5 percent of the volume of water which would otherwise penetrate the sand if the mats were not there. This substantially prevents the sand underneath the mats from liquifying under the waves as the waves pass over the sand.

Sandbags 20 are quite large. Each bag can be on the order of 5 feet wide and 10 feet long when unfilled, and holds about 9,000 pounds of sand or concrete. These figures are not extremely critical; the sizes and capacities of the bags can be increased or decreased somewhat.

Each bag 20 is filled with sand or concrete through openings 23*a* and 23*b* cut through two layered patches 21*a* and 21*b* (FIGS. 3B–3D) stitched to the upper face of bag 20. Provision for filling the openings is made by stitching two square patches 21*a* and 21*b* of the same size, one directly above and overlying the other to the upper surface 20*a* of bag 20. The stitches 25 extend completely around the periphery of the layered patch arrangement, through the two patches 21*a* and 21*b* and through the bag fabric forming the upper face 20*a* of bag 20. Each patch 21*a* and 21*b* is about one square foot.

Figure 3A:
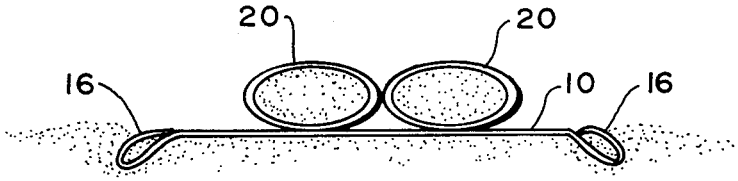
FIG. 3A is a cross section taken along the plane of line IIIA—IIIA of FIG. 2.
Figure 3B:
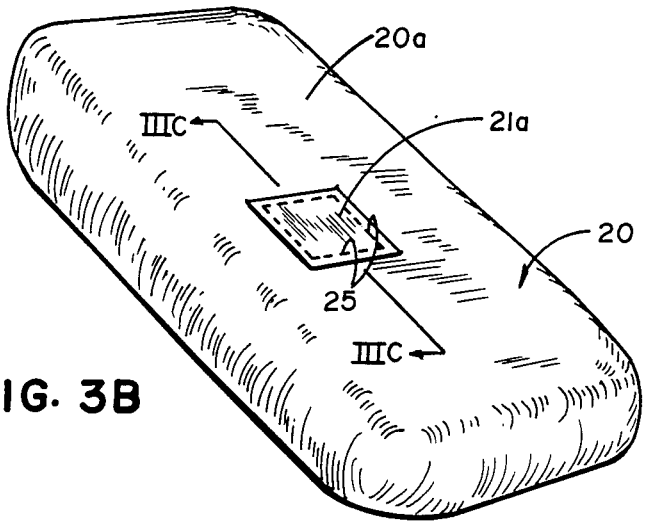
FIG. 3B is a perspective view of an erosion control bag of the present invention.
Figure 3C:
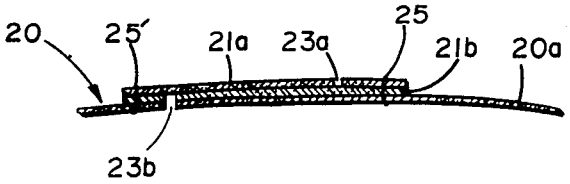
FIG. 3C is a cross section taken along the plane of line IIIC—IIIC of FIG. 3B.
Figure 3B:
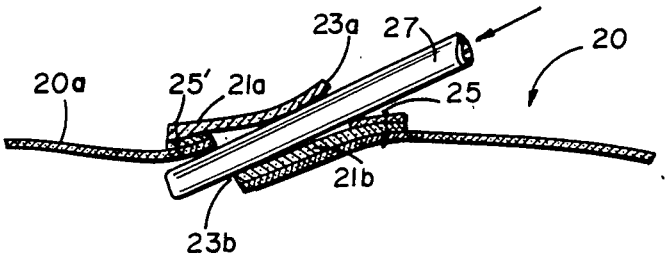

After the bags are brought to the installation site, a slit 23*a* is made with a knife or other cutting instrument across patch 21*a* close to and parallel with a first seam 25 (FIG. 3C). The slit 23*a* need be only about 6 inches long. Another slit 23*b* is made completely through patch 21*b* and the upper surface 20*a* of bag 20. However, slit 23*b* is close to and parallel with a second seam 25' which is parallel to the first seam 25 (FIG. 3C). Thus, the two slits, 23*a* and 23*b*, are offset from one another so that after the bag is filled, the aggregate material in the bag cannot work its way out of the bag. When the bag is filled, the tension on the fabric will force the uncut portion of patch 21*a* immediately above slit 23*b* to tightly cover slit 23*b*, preventing sand from escaping.

To fill bag 20, an injector nozzle 27 (FIG. 3D) is inserted through slit 23*a*, between patches 21*a* and 21*b*, and then through slit 23*b* into the bag's interior. A sand-water or cement slurry is then injected into the bag through nozzle 27. The water filters out of the bag because the bag is made of permeable fabric, leaving the sand (or cement) in the bag. The sand in the bag will not escape through slits 23*a* and 23*b* for the reasons explained above.

The stabilizers or sandbags 20 placed on top of the mat should be placed such that in the locations where currents exceed the sand entrainment or erosion velocity, the bags are positioned sufficiently below the surface of the water such that the waves and currents can go over the bags. As indicated above, currents deflecting from the structure cause the sand-laden currents to be directed away from shore into deeper water where the sand deposits instead of depositing in near shore areas and building beaches. Waves reflecting downwardly cause the structure to be undermined by erosion at the foot of the structure.

Figure 4:
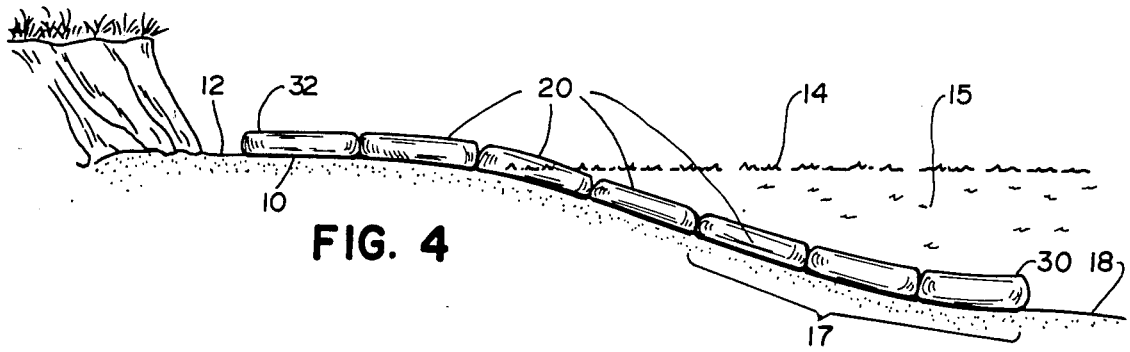
FIG. 4 is a side profile of the erosion control system of FIG. 1.

As shown in FIG. 4, for example, deep and portion 17 of each erosion control structure 22 is positioned below the water surface where the littoral zone currents running parallel or at an acute angle to shore previously exceeded the erosion velocity. Because deep end portion 17 remains below the surface of the water, the littoral currents and waves will be urged gently upwardly over the structure such that their kinetic energy will be dissipated. This lowers the velocity of the currents such that sand will deposit, not erode. Again, the deep end portion 17 should remain sufficiently far below the water surface in the erosion current zone such that the currents will be gently forced upwardly and not reflected away or downwardly from the structure.

As shown in FIG. 4, it is possible to have portions of structures 22 project above the surface of the water, and in fact be placed directly on beach 12 itself. However, these portions are close to shore where the current velocity is not sufficient to entrain large amounts of sand, at least when compared to the currents somewhat further offshore. Furthermore, placing a portion of the erosion control structure above the main waterline 14 actually serves to retard erosion in periods of high tide. In high tide periods, a greater portion of the length of each erosion control structure 22 is below the surface of the water where eroding currents can be dissipated.

Even in inland lakes, such as the Great Lakes, where tides do not occur, placing a portion of the length of each erosion control structure 22 on the beach serves to catch and accumulate sand in stormy periods. When storms arise, the waves carry sand captured at the toe or deep water end 30 of the erosion control structure (see FIG. 4) to the head or above water end 32 of the structure on the beach, depositing sand on the beach. The portion of the structure on the beach, therefore, functions to prevent sand from being washed back into the lake.

As shown in FIG. 3, bags 20 can be stacked with two parallel rows of bags placed directly on mat 10. This arrangement is not an inflexible rule. In some circumstances, one row or even three rows placed in a pyramid fashion on the mat will suffice. The idea is to have the structures project upwardly from the bottom of the ocean or lake bottom a sufficient distance such that they slow the waves and currents, not deflect them.

In most instances, it is necessary to place a plurality of erosion control structures 22 comprising the foundation mat 10 and bags 20 parallel to and spacedly positioned from one another perpendicular to the shoreline as shown in FIG. 2. Often, the deep end portion 17 of one structure 22 will not sufficiently dissipate currents. However, three or more such structures will reduce the current velocity because the cumulative effect of each of the structures forces the currents gently upwardly and reduces the current velocity below the erosion velocity. When this happens, the currents no longer entrain sand, they deposit it, allowing the beaches protected by the devices to accrete.

Once enough material has deposited along and between the first series of parallel structures 22, structures 22 will actually become almost completely buried in sand. At this point, additional structures can be installed along the new shoreline, as will be described below.

Figure 11:
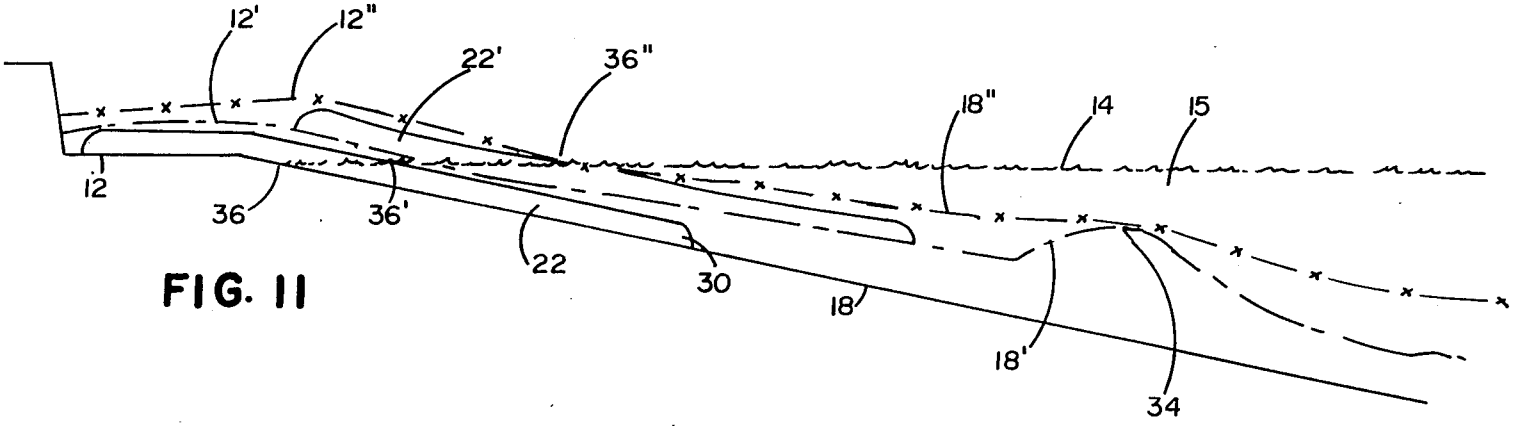
FIG. 11 is a side profile view illustrating the placement of a series of erosion control structures over time as beach material accretes.

As shown in FIG. 11, for instance, a first erosion control structure 22 of a series of such parallel structures is placed on the original bottom 18 of the lake with the toe 30 of the structure at a depth and a distance into the lake or water body 14 where it performs the current dissipating function described above. Over a matter of months, in most instances, sand accumulates around and between the parallel erosion control structures 22 and forms a new bottom 18'. Often, a protective sandbar structure 34 forms parallel to shore at a distance from the toe 30. It is believed that the sandbar structures 34 form as a direct result of the current dissipating characteristics of the structures 22 described above. Furthermore, sandbars 34 tend to be quite stable since currents are not deflected and waves are not deflected away from structures 22 toward deeper water.

Over time, therefore, new bottom 18' will eventually cover the original structure 22 and form a new beach 12' above structures 22. Raising the beach to a new level 12' (FIG. 11) actually forces the old shoreline 36 to retreat outwardly from the old beach 12 to a new shoreline 36' which can be as much as 30 to 60 feet from the old shoreline.

If sandbars 34 form, it is often not necessary to do anything else to restore the beach since the sandbags serve as a natural protection for the beach. However, additional beach can be added if sandbars 34 do not form or if even more beach is desired if they do form, by placing a second series of parallel structures 22' on the new bottom 18'. The second structures 22' raise the bottom to a second level 18'', and raise the beach even higher to a third level 12''. Similarly, the shoreline retreats to a third position 36'' further out into the water body than the second waterline 36'.

Each of the second structures 22' do not have to be placed directly on top of a first structure 22. Instead, each second structure 22' can be staggered intermediate two first parallel structures 22. Furthermore, second structures 22' do not need to be the same length as first structures 22. Depending upon where the high velocity erosion currents are located after the first structures cause the first bottom 18' to form, the second structures 22' should be positioned to extend outwardly from the beach to dissipate those currents and to reduce their velocities such that sand will deposit, not erode.

A third series of structures (not shown) can be placed above and beyond the second structures 22' shown if it is desired to extend the beach even further.

In one installation using a version of the erosion control structures described below, a beachfront property of about 250 feet in width was restored using this type of device and method. Currents had eroded the original beach and were eroding at the base of a 30-foot bluff upon which a house was situated. To save the house and restore the beach, three perpendicular erosion control structures, each about 60 feet long and 6 to 10 feet wide, were placed 70 to 80 feet apart along the 250-foot frontage. Only about 10 feet of the 60 foot length of each of the structures was placed at the foot of the bluff above the waterline. The remainder of each of the structures extended downwardly into water which dropped off to a depth of about 10 feet at the toe of each of the structures. In several months, sand accumulated around the three structures such that a beach was formed which pushed the shoreline to within about 10 feet of the toes of each of the first structures.

At that point, a second series of structures was placed generally parallel to the first series. The second structures were about 60 feet long and 10 feet wide and were placed such that the head of each structure was located about 10 feet from the new shoreline and the toe extended into water that was about 4 to 5 feet deep. The second structures were placed in a staggered relationship with respect to the first structures. Soon, the shoreline was pushed back another 40 feet or so from the second waterline as sand accumulated around the second series of structures.

To stabilize the beach further, a third series of erosion control structures was installed. Each of the third structures was about 100 feet long and 12 feet wide and placed 130 to about 150 feet apart. The third structures were placed such that their heads were approximately even with the heads of the second structures, and their feet extended roughly 40 feet beyond the feet of the second structures. Sand soon engulfed the second structures such that at the present day, the shoreline has been pushed outwardly from the original shoreline about 100 feet.

The placement of these structures perpendicular to shore and extending outwardly therefrom is desirable in instances where it is difficult to organize a great number of beachfront property owners or where it is necessary to save immediately an expensive building or house from toppling into the water.

Figure 12:
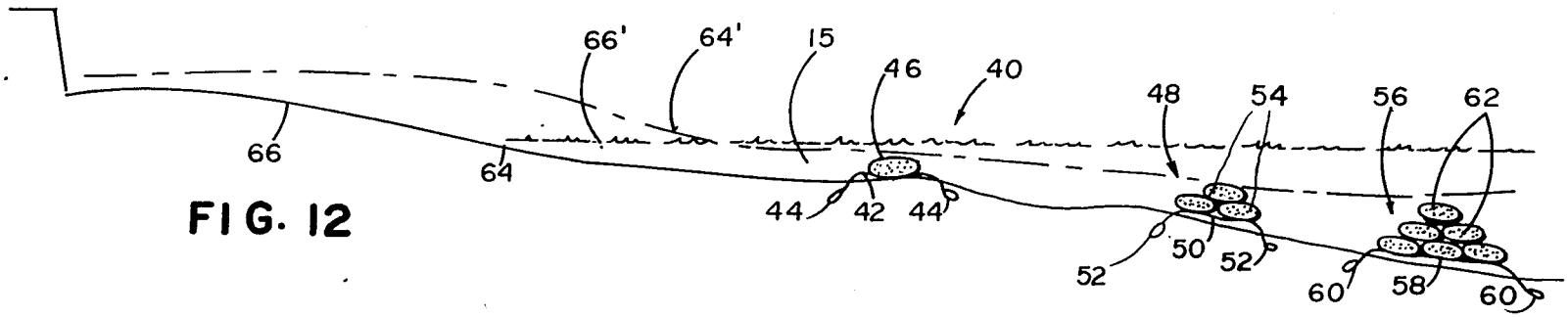
FIG. 12 is a side profile view in section of an alternative method of employing the erosion control structures of the present invention.

As shown in FIG. 12, three parallel artificial sandbars are placed parallel to the shoreline. Artificial sandbars are installed parallel to shore where long seawalls or other elongated structures have created a long stretch of deep water near shore. If the water is still shallow near shore, the structures are placed perpendicular to shore, as illustrated in FIGS. 1, 2, 4, 8 and 11. As shown in FIG. 12, first artificial sandbar 40 is constructed parallel to shore by placing on the lake or ocean bottom parallel to shore a first elongated mat 42 with peripheral weighted pockets 44 extending completely around the mat 42 having spaced openings identical to openings 28 described above. A single row of sand-filled bags 46 is then placed along the length of the mat 42. The mats 42 and bags 46 are positioned parallel to shore in a depth of water such that bags 46 dissipate currents running at acute angles with respect to the shoreline. Again, first sandbar 40 is placed at a position where the velocity of the water is sufficient to entrain sand or other debris at the bottom of the water body. However, it does not break through the water surface so as to deflect the currents or waves toward deeper water. Instead, the currents will be dissipated by being forced to move gently over the first sandbar 40.

A second artificial sandbar 48 can be placed parallel to the first in even deeper water than the first. Artificial sandbar 48 also has an elongated mat 50 with peripheral pockets 52 filled with sand or other weighted material holding the mat against the bottom of the water body. In a second sandbar 48, three rows of sand-filled bags 54 are placed in a pyramid configuration on mats 50. Again, the second articifical sandbar 48 is positioned such that it dissipates rather than reflects the currents and waves.

A third artificial sandbar 56 can be positioned outwardly from and parallel to the first two artificial sandbars in even deeper water to dissipate currents further from shore. Again, the third sandbar is constructed from a base mat 58 with peripheral pockets 60 filled with a weighted material. A pyramid of five rows of stacked bags 62 is positioned atop and along the length of mats 58.

This arrangement of parallel artificial sandbars has been found over time to raise the original bottom 64 to a level such that it covers the three artificial sandbars at a new elevation 64'. Again, wave action will force a certain amount of additional sand on the beach such that the original shoreline 66 retreats seawardly to a new position 66' as sand accretes due to the current and wave dissipation of the three artificial sandbars.

The artificial sandbars 46, 48 and 56 should be placed such that the tops of the artificial sandbars are located at a level approximately where the new sea bottom 64' is to be located. Furthermore, the artificial sandbars should be placed sufficiently far apart that waves passing over one artificial sandbar will not break against the next artitifical sandbar but instead will substantially dissipate between the two. Waves should break between the artificial sandbars.

The pyramids of three rows of bags in bar 48 and five rows of bags in bar 56 are not critical. As indicated above, the object is to make the tops of the bars extend to a level where the new sea bottom is to be located. In some circumstances, therefore, a five row pyramid may be unnecessary because the bottom may not have to be raised that far.

No matter whether the structures are oriented perpendicular to or parallel to the shoreline, the base mats with the peripheral weighted pockets will insure that the mats will not get washed away and will prevent sandy, granular material underneath them from liquifying or becoming the consistency of quicksand where the structures could sink into the bottom.

It has been found that in using the sandbag stabilizer means on top of mats 10, the sandbags, even though they each contain several tons of sand, will occasionally topple from the mats. This is believed to be the result of an upward movement of the mat structure as waves pass over it. As a wave passes over the structure, the mats permit only a fraction of the water to penetrate the sand beneath the mat. However, the full pressure of the wave can be transmitted to the sand on either side of the mat. It is believed that this forces sand underneath the mat from the sides around the downwardly oriented peripheral pocket and actually begins to move the mat and the stabilizer structure on top of it upwardly toward the surface. When the erosion control structure moves upwardly, it has almost never been found that the weighted bags on top of the mat break through the surface of the water or assume an elevation where they reflect rather than dissipate the waves and currents. The entire structure apparently lifts to a point where a natural equilibrium is established between the depth of the structure and the strength of the currents and waves.

Figure 7:
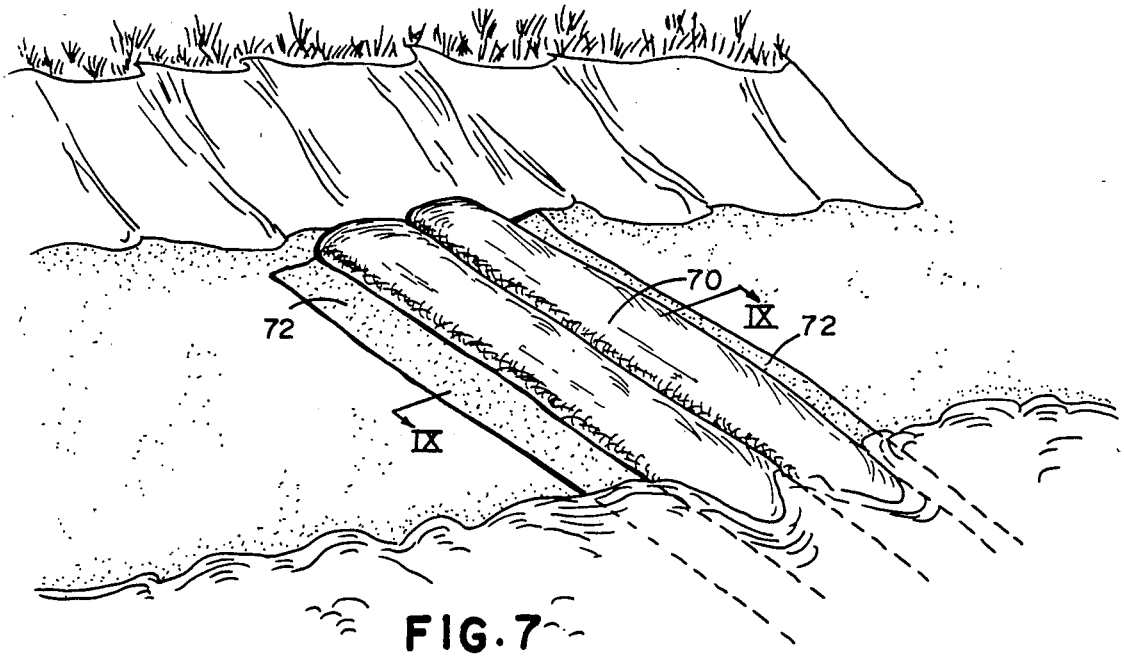
FIG. 7 is a partial perspective view of an alternative erosion control device of the present invention.
Figure 8:
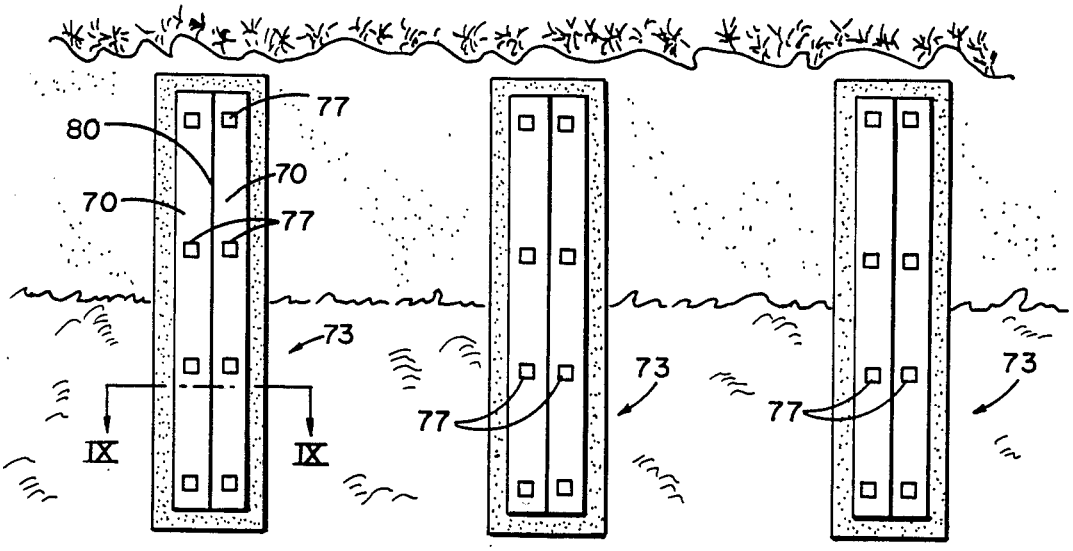
FIG. 8 is a top elevation of an erosion control system according to the present invention.
Figure 9:
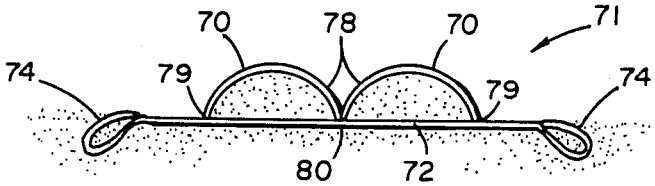
FIG. 9 is a cross section taken along the plane of line IX—IX of FIG. 8.

To take advantage of this uplift phenomenon, a different, preferred structure was developed. As shown in FIGS. 7–9, two parallel central pockets 70 are sewn directly onto the center part of a permeable mat 72 with peripheral pockets 74 extending completely around the edges of mat 72. Mat 72 is identical in construction to the mat 10 described above including the provision of spaced openings 76 in peripheral pockets 74 created by leaving unstitched portions in the hems which form peripheral pockets 74.

The two central pockets 70 are formed by laying an upper sheet of permeable fabric 78 along the center of mat 72, stitching the edges of upper sheet 78 directly to the upper surface of mat 72 and then stitching the middle of upper sheet 78 to the middle of mat 72 by running a middle stitch 80 between and parallel to the stitches 79 along the elongated side edges of upper sheet 78.

The sand is injected in a slurry of water into the central compartments through openings described below. The porosity of upper sheet 78 and mat 72 should be sufficient such that the water in the slurry filters out of the central pockets 70 leaving the particulate matter behind. Geotextile fabrics sold by Phillips Fibers Corporation under the mark SUPAC have been found to work well. Cement, mortar or other such hardenable substances can also be injected into central pockets 70.

Figure 10:
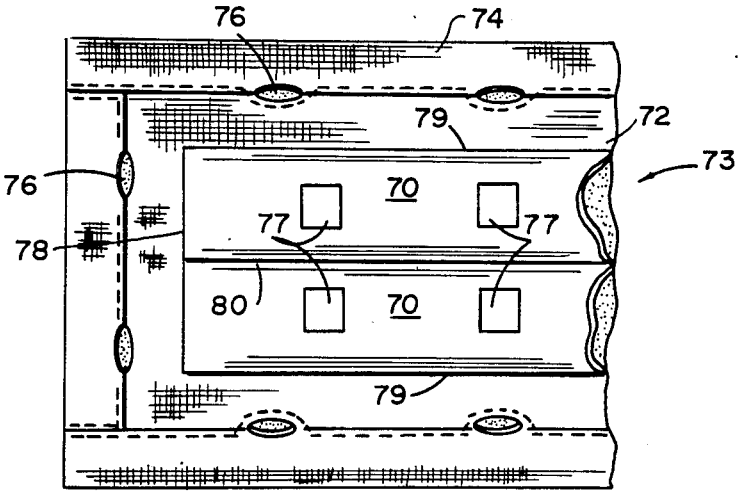
FIG. 10 is a detail top elevation of the erosion control structure of FIGS. 7 and 8.

To inject sand or concrete into central pockets 70, a plurality of double-layered patch arrangements 77 (FIGS. 8 and 10) are spaced 10 to 20 feet apart along the length of each central pocket 70. Each layered patch arrangement 70 is constructed identically to the layered patches **21*a* and 21*b* shown in FIGS. 3B–3D. Not all of the layered patch arrangements 77 need to be sliced and opened with offset slits for injection of slurry. Often, only one of the layered patches 77 needs to be opened because sand can be injected throughout the entire compartment. However, sometimes a large kink develops in the central compartment where the unit is laid over a sharp dropoff or other obstruction along the lake or ocean bottom. In such situations, layered patches on either side of the obstruction are sliced with offset slits and slurry is injected into the compartment through openings cut on either side of the obstruction. Similarly, the injection equipment may not be able to generate the pressure necessary to inject slurry throughout the entire central compartment from one sliced layered patch 77 if the compartment is particularly long. Therefore, slurry is injected into the compartment through several sliced layered patches 77**.

Each central pocket 70 should extend 24 to 28 inches above mat 72 when filled. This height has been found sufficient to perform the current and wave energy dissipation function described above.

It has been found that the hydraulic pressure on the sand on each side of mat 72 generated by the waves forces sand underneath mat 72 and moves the structure upwardly. The structure has never been found to move upwardly to a point where it will reflect currents and waves, however. The advatange of having the central pockets sewn onto the mats is that the pockets cannot topple from the mats. It also eliminates guesswork in estimating how many tiers or levels of sandbags have to be placed on the mats because the structures will be raised naturally to the proper current-dissipating height from the original bottom as the bottom underneath the mat rises. After the structure rises to the proper depth, sand fills around and between a series of parallel structures (FIG. 8), eventually covering them.

Another advantage to the embodiment illustrated in FIGS. 7–10 is that each unit can be sewn beforehand and rolled or folded for shipment. On site, the unit can simply be unrolled and filled. Preferably, the units are filled with in situ underwater sand to avoid having to bring heavy trucks laden with sand or concrete on location. Apart from shipping costs involved, trucks can damage dune or other sensitive wildlife areas along the shoreline.

The erosion control device shown in FIGS. 7–10 is positioned along the shoreline either perpendicular (FIG. 8) or parallel to the shoreline, in the same fashion as the structures 22 described above are positioned. It is very easy to install a plurality of such devices quickly because there is no need to handle and fill many large, individual sandbags.

It should also be noted that having two parallel central compartments is not critical. In some cases, only one long compartment or more than two parallel central compartments can be used.

The fabrics used to make the bags, mats and central pockets of the erosion control devices described above are preferably coated with substances which protect the fabrics from ultraviolet and infrared light and mildew. Coatings having substituted benzophenones and titanium dioxide can protect the fabric from ultraviolet and infrared light. Mildew and bacteria can be inhibited by using triphenyltin monophenoxide in the coatings. Such coatings are known in the art (see Heptworth U.S. Pat. No. 3,957,098 entitled EROSION CONTROL BAG, issued on May 18, 1976, for instance).

Figure 13:
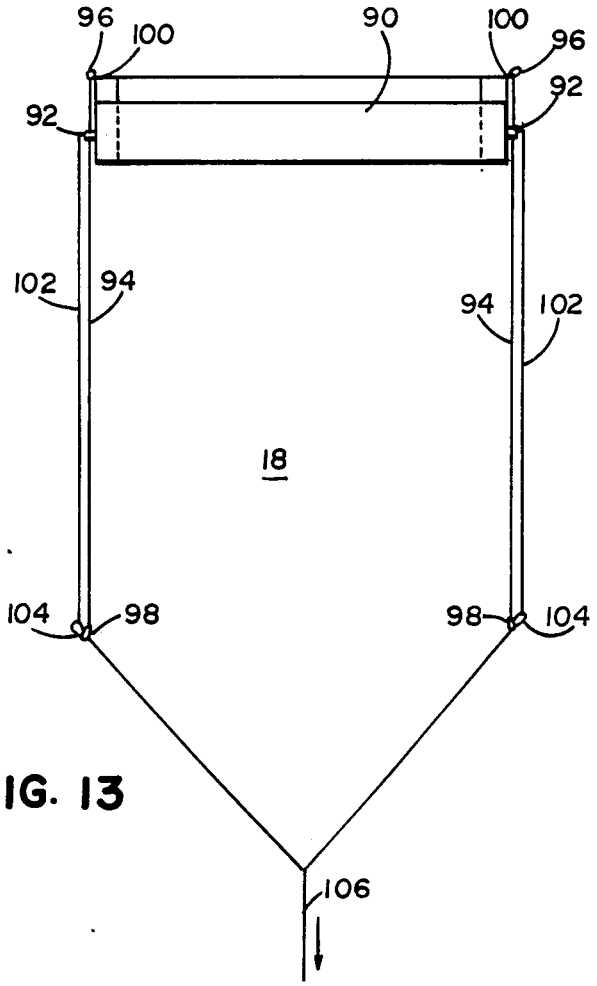
FIG. 13 is a plan view of a method of installing the erosion control devices of the present invention with one device shown rolled.
Figure 14:
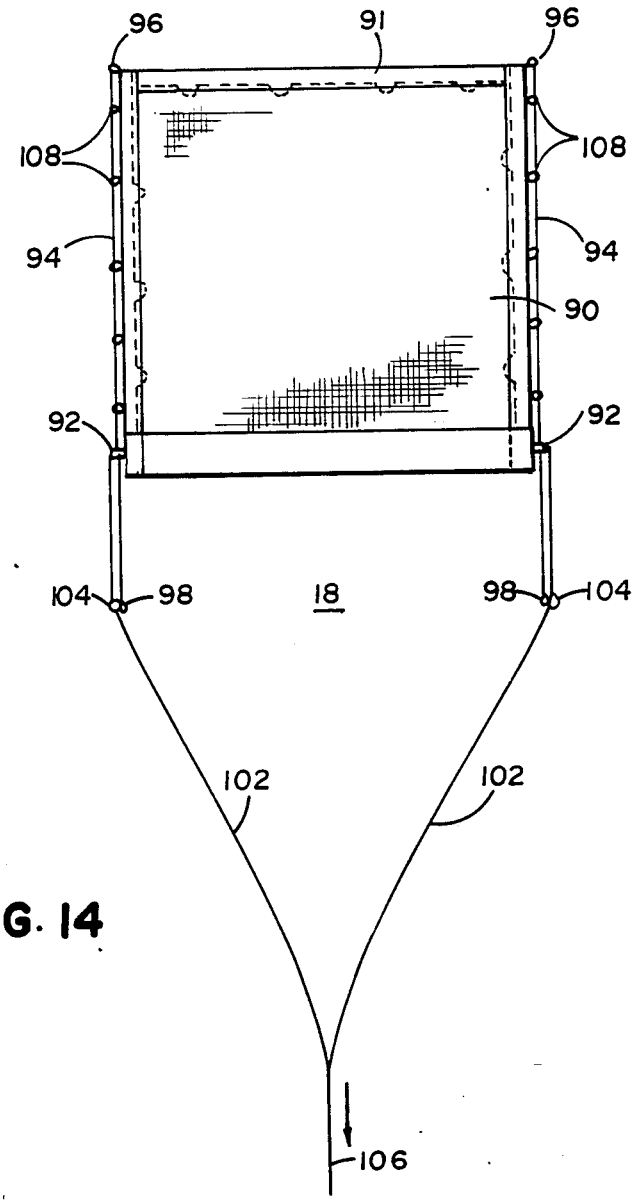
FIG. 14 is a plan view of a method of installing the erosion control devices of the present invention with one device shown partially unrolled.

The method of installing the erosion control devices of the present invention is shown in FIGS. 13–14. As indicated above, mat 10 without the central compartments or the mat structure with central compartments 70 can be rolled for shipment and unrolled at the installation site for accurate and easy placement. Mat structure 90 is rolled onto a tube 92 so that the openings of the peripheral pockets will be oriented upwardly when the mat structure is unrolled from tube 92.

Two guide cables 94 are positioned parallel to one another on either side of the area over which the mat structure is to lay. Guide cables 94 are positioned sufficiently far apart so that the rolled mat structure can be placed between them as shown in FIG. 13. The ends of each guide cable 94 are anchored securely to the ocean (lake) bottom 18 by screw anchors 96 and 98 which screw into bottom 18.

The rolled mat structure 90 is positioned between guide cables 94 near the first ends of guide cables 94 secured to screw anchors 96. The first two corners 100 of mat structure 90 are secured to screw anchors 96 or the first ends of cables 94 by means to be described. Then, a second cable 102 is secured to each end of tube 92 on which mat structure is rolled. Each of the second cables is then laid next to one of guide cables 94.

Figure 15:
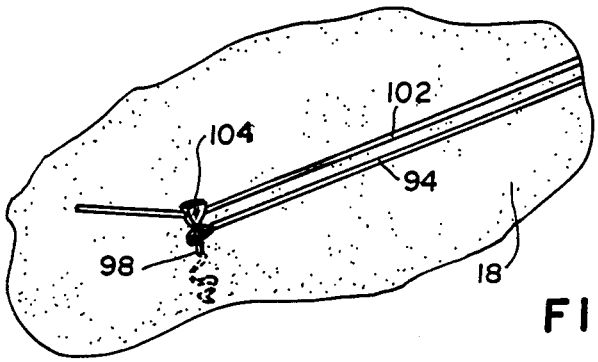
FIG. 15 is a detailed perspective view of a pulley arrangement used to unroll the rolled erosion control device.

A pulley 104 (FIGS. 13–15) is pivotally secured to each screw anchor 98. Second cables 102 are drawn through pulleys 98 and joined together beyond screw anchors 98 to a tow cable 106. Tow cable 106 is then pulled with a boat, a wench, or an underwater propulsion device so that second cables 102 are pulled through pulleys 104 and mat structure 90 is unrolled.

Figure 16:
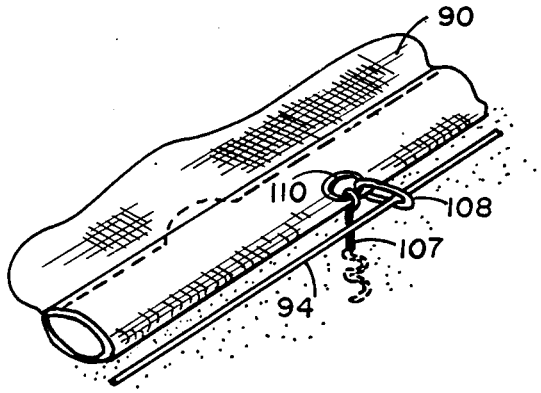
FIG. 16 is a detailed perspective view of an edge of an unrolled erosion control device fastened to a temporary guide cable.

As mat structure 90 is unrolled, its edges are fastened to guide cables 94 by fasteners 108 (FIG. 16). Fasteners 108 are loops of wire, strapping material or the like which loop around cables 94 and are received by grommets 110 along the edges of mat structure 90 (FIG. 16). Grommets 110 are about 10 to 15 feet apart (FIG. 15) along the two elongated sides of the mat structure. Grommets 110 and fasteners 108 can be used to secure corners 100 to screw anchors 96 as well.

As the mat structure is being unrolled, it must be anchored directly to the sea bottom along its edges because screw anchors 96 and 98 and cables 94 cannot hold the mat down by themselves against strong currents. Screw anchors 96 and 98 will pull out if strong currents get underneath the mat structure. To prevent this, a screw anchor 107 (FIG. 16) is screwed into sea bottom and connected to each grommet 110 along the sides of mat structure 90. With a plurality of screw anchors 107 anchoring the edges of the mat and screw anchors 96 and 98 anchoring the corners, the mat will not lift under strong currents before the peripheral pockets fill or are filled with sand. After the peripheral pockets are filled, anchors 96, 98 and 110 are removed to allow the peripheral pockets to assume their downward orientation and anchor the mat structure to the sea bottom.

If mat structure 90 is the type that has central compartments, they are then filled with sand. If some other stabilizer means, such as sandbags, is used, they can be positioned on top of mat structure 90 if it lacks central compartments.

The installation method described above can be used no matter whether the devices are positioned parallel or perpendicular to shore. If perpendicular, screw anchors 96 are anchored and screwed into the beach above the water-line; screw anchors 98 are anchored into bottom 18 below the waterline. If parallel, all the screw anchors will be underwater.

It can be seen that it is extremely easy to construct and install the beach restoration devices of the present invention. The basic devices, namely, the mats and bags or compartments, are made of sewn fabric, which is very easy to manufacture and transport. The rolled mat assemblies are transported to the installation site and unrolled with very simple equipment and with the help of several divers. No heavy equipment is required if sand is available on site. The sand slurry is pumped into the peripheral pockets and central compartments or bags, and installation is complete.

After the mat structure is unrolled, cables 102 and tube 92 are removed. After the mat structure peripheral pockets 91 are filled with sand, cables 102, screw anchors 96 and 98, and fasteners 108 are removed. The sand-filled peripheral pockets are sufficiently heavy to hold the mat stretched out overlaying the bottom so that currents cannot move the mat before or during filling of the central compartments or bags.

While several embodiments of the invention have been disclosed and described, other modifications will be apparent to those of ordinary skill in the art. The embodiments described above are not intended to limit the scope of the invention which is defined by the claims which follow.

The embodiments of the invention in which an exclusive property or privilege is claimed are defined as follows:

1. A method of restoring coastal shoreline of a water body having a surface, a bottom with granular material on said bottom, and having erosion zones in which currents exceed an erosion velocity, comprising:

providing a generally flat water permeable geotextile sheet having peripheral edges;

forming peripheral pockets extending around said peripheral edges of said sheet and forming a plurality of spaced openings along said pockets such that said sheet is provided with a substantially flat central region intermediate said peripheral pockets;

positioning said sheet at said shoreline so as to extend into said water body such that at least a portion of said sheet is positioned along said bottom where currents exceed said erosion velocity sufficient to entrain granular material on said bottom;

filling said peripheral pockets with ballast material such that said peripheral pockets assume a downwardly oriented substantially vertical position in the granular material along said bottom;

providing a flexible stabilizer chamber separable from said sheet;

placing said stabilizer chamber on said substantially flat central region of said sheet with said peripheral pockets spaced from said stabilizer chamber and extending around said stabilizer chamber; and filling said stabilizer chamber with ballast material such that said stabilizer chamber extends upwardly in a low profile from said sheet into said currents, but at least a portion of said stabilizer chamber is disposed beneath said surface sufficient to permit water currents to pass over said stabilizer chamber.

2. The shoreline restoration method of claim 1 which further comprises filling said central compartment with in situ granular material after positioning said sheet.

3. The shoreline restoration method of claim 1 wherein said sheet positioning step includes:

rolling said sheet into a roll;

positioning a pair of first cables as parallel guide cables along said bottom, said first cables each having first ends and second ends;

anchoring said ends of said first cables;

placing said rolled sheet between said first cables adjacent said first ends of said first cables;

unrolling said rolled sheet between said first cables over said bottom; and temporarily fastening the edges of said sheet to said first cables.

4. The shoreline restoration method of claim 3 wherein:

rolling said sheet further includes rolling said sheet onto an elongated member having a pair of ends, said sheet being rolled such that said elongated member ends are accessible from either end of said rolled sheet;

providing a pair of second cables each having first ends and second ends;

unrolling said sheet further comprises fastening said first ends of said second cables to said elongated member ends;

providing pulley means near said second ends of said first cables;

extending each of said second cables through one of said pulley means so that said second cables and said first cables are generally parallel to each other; and pulling said second cables so that said rolled sheet unrolls from said elongated member.

5. The method of claim 1, wherein:

said stabilizer chamber placing step includes limiting the placing of said stabilizer chamber on said sheet to a single layer thereof placed on said sheet.

6. A method of retarding shoreline erosion of a water body having a shoreline, a water surface, a bottom and an erosion zone in which currents exceed an erosion velocity, comprising:

providing an elongated sheet of permeable fabric having a length substantially greater than the width thereof, said sheet having two opposite lengthwise edges;

forming peripheral pockets along said lengthwise edges and attached to the periphery of said sheet;

positioning said sheet such that at least a portion of said sheet extends along said bottom of said water body into a shallow region of said water body where currents have a velocity sufficient to erode said bottom;

filling said peripheral pockets with weighted material;

providing an elongated weighted stabilizer means having a length substantially greater than the width thereof; and positioning said weighted stabilizer means along a central region of said sheet to extend a majority of the length of said sheet, such that in a region of said erosion zone said stabilizer means project upwardly from said sheet but is disposed below the surface of the water, and is adapted to cause particulate accretion about said weighted stabilizer means.

7. The method of claim 6 which further includes positioning said stabilizer means sufficiently below said water surface in said erosion zone such that said currents are forced upwardly over said weighted stabilizer means whereupon the velocity of said currents is reduced, and such that said currents do not reflect substantially downwardly toward said bottom to scour said bottom and do not reflect substantially away from said stabilizer means to carry particulate matter away from said erosion zone.

8. The method of claim 7 which further includes filling said peripheral pockets with weighted material having a weight of at least about 90 pounds per linear foot of said peripheral pockets.

9. The method of claim 6 which further includes forming said peripheral pockets by folding each edge of said sheet over on said sheet to form hems and fastening the folded edges in folded position.

10. The method of claim 9 wherein:

said folding includes folding all said hems to the same side of said sheet and which further comprises forming a plurality of spaced openings along said fastening of said folded edges, said openings being formed on one side of said sheet, whereby said hems are provided with the ability to fill by themselves with granular material on the bottom of said water body.

11. The method of claim 10 wherein:

said hems are fastened and said openings are formed by stitching said folded edges to said sheet while leaving spaced unstitched regions to create spaced openings.

12. The method of claim 11 which includes positioning said sheet on said bottom with said openings oriented upwardly from said bottom.

13. The method of claim 9 wherein:

said peripheral pockets are filled with a cementitious material.

14. The method of claim 9 wherein:

said pockets are filled with sand and which further includes liquifying sand on said bottom of said water body and injecting said liquified sand into said peripheral pockets.

15. The method of claim 6 wherein:

said stabilizer means is provided by forming at least one compartment from a permeable flexible material and filling said compartment with a weighted material.

16. The method of claim 15 wherein:

said sheet has a length, and said compartment is formed by disposing at least one elongated tubular central pocket on said sheet to extend substantially the length of said sheet.

17. The method of claim 16, wherein said compartment is filled with a cementitious material.

18. The method of claim 16 wherein: said sheet is a first sheet;

said central pocket is formed by placing a second sheet of permeable material over said first sheet, and stitching said second sheet around its periphery to one side of said first sheet.

19. The method of claim 18 which further includes:

stitching the center of said second sheet to the center of said first sheet by stitching a central stitch lengthwise down the middle of said two sheets, thereby forming two central compartments, one on either side of said central stitch.

20. The method of claim 19 wherein:

said two compartments are filled with sand.

21. The method of claim 6 which further comprises:

providing a plurality of structures each comprising said sheet having said peripheral pockets with said weighted stabilizer means on each said sheet; and positioning said plurality of said structures generally spaced from and parallel to one another.

22. The method of claim 21 wherein:

said structures positioning step includes positioning said structures to extend generally perpendicular to said shoreline.

23. The method of claim 21 wherein:

said structures positioning step includes positioning said structures to extend generally parallel to said shoreline and spaced from said shoreline.

24. An erosion control structure adapted to retard erosion along a body of water having a shoreline, a water surface, a bottom and an erosion zone in which currents have an erosion velocity, comprising:

an elongated permeable fabric mat having a pair of longitudinal edges and having a pair of peripheral pockets extending along said longitudinal edges thereof, said peripheral pockets adapted to hold ballast material and anchor said mat in said bottom;

stabilizer means comprising a flexible compartment having sides and a submergable end, said flexible compartment adapted to be filled with ballast material and positioned atop and extending upwardly from a medial region of said mat;

said mat dimensioned to extend outwardly from said stabilizer means sides when said stabilizer means is positioned thereon, said mat spacing said peripheral pockets from said stabilizer means to provide a generally flat fabric section on each side of said stabilizer means, whereby said mat can be laid such that said mat extends along said bottom to said erosion zone whereat said currents exceed the erosion velocity and said stabilizer means placed atop said mat to project upwardly from a central region thereof, with said mat providing a supporting base wider than said stabilizer means when in a filled condition and disposing a region of said stabilizer means below said water surface causing soil particles to accumulate around said erosion control structure.

25. The erosion control structure of claim 24 wherein:

said peripheral pockets have a plurality of spaced openings which are adapted to be oriented upwardly when said mat is positioned along said bottom.

26. The erosion control structure as recited in claim 25 wherein:

said mat has an upper surface;

said peripheral pockets comprise a hem sewn along each said longitudinal edge of said mat by folding said edges over said mat and stitching said edges to said upper surface of said mat.

27. The erosion control structure of claim 26 wherein:

said openings comprise spaced unstitched regions of said stitched edges.

28. The erosion control structure as recited in claim 27 wherein:

said stabilizer means comprises an upper sheet having edges, said upper sheet secured around said upper sheet edges to said upper surface of said mat forming at least one compartment adapted to receive weighted material.

29. The erosion control structure as recited in claim 28 wherein said upper sheet is secured to said mat so as to form two compartments for receiving weighted material.

30. The erosion control structure as recited in claim 24 wherein:

said stabilizer means comprises a plurality of bags made of a permeable material and adapted to be filled with a weighted material.

31. The erosion control structure of claim 24 wherein:

said compartment includes at least one layered patch assembly comprising two patches placed one on the other on said compartment, and said patches fastened around the peripheries of said patches to said compartment, whereby slits can be cut through said patches and into said compartment for injecting weighted material into said compartment.

32. The erosion control structure of claim 24, wherein:

said stabilizer means comprises an elongated tubular compartment extending substantially the length of said mat.

33. The erosion control structure of claim 32, wherein said stabilizer means is adapted to be filled with cementitious material.

34. The erosion control structure of claim 33, wherein:

said mat has a length substantially greater than the width thereof; and said stabilizer means has a length substantially greater than the width thereof.

35. The erosion control structure of claim 24, wherein:

said stabilizer means is limited to a single layer of said stabilizer means disposed on said mat.

36. The erosion control structure of claim 35, wherein:

said stabilizer means placing step includes placing a plurality of rows of said compartments on said mat.

37. A method of installing erosion control apparatus at a shoreline along a body of water, comprising:

providing an elongated mat having longitudinal sides and an anchoring compartment extending along each said longitudinal side thereof, said mat having a length substantially greater than the width thereof;

providing an elongated tubular element having a length substantially greater than the width thereof;

positioning said elongated mat to extend out into said body of water;

filling said anchoring compartments with ballast material;

positioning said elongated tubular element on said mat to extend out into said body of water; and filling said elongated tubular element with ballast material.

38. The method of claim 37, wherein:

said elongated tubular element filling step includes filling said elongated tubular element with a cementitious material.

39. The method of claim 37, wherein:

said elongated tubular element providing step includes providing a plurality of said elongated tubular elements.

40. The method of claim 39, wherein:

said elongated tubular element positioning step includes positioning said plurality of elongated tubular elements laterally adjacent each other at a medial region of said mat.

41. The method of claim 40, wherein:

said elongated tubular element providing step includes securing said elongated tubular elements together.

42. The method of claim 41, wherein:

said elongated tubular element positioning step includes securing said elongated tubular elements to said elongated mat.

43. The method of claim 37, wherein:

said elongated tubular element filling step includes pumping filling material into said elongated tubular element through a single inlet.

44. A method of installing erosion control apparatus at a shoreline along a body of water, comprising:

providing an elongated mat having longitudinal sides and an anchoring compartment extending along each said longitudinal side thereof;

providing a plurality of laterally adjacent flexible elongated tubular compartments, said elongated tubular compartments secured together to provide longitudinal sides, and said elongated tubular compartments disposed on a medial region of said mat so that a generally flat section of mat extends to each said longitudinal side of said elongated tubular compartments;

positioning said elongated mat and said elongated tubular compartments to extend from said shoreline out into said body of water;

filling said anchoring compartments with fill material; and filling said elongated tubular compartments with fill material.

45. The method of claim 44, wherein:

said elongated tubular compartments filling step includes filling said elongated tubular compartments with a cementitious material.

46. The method of claim 45, wherein:

said elongated tubular compartments filling step includes pumping filling material into said elongated tubular compartments through a single inlet in each said elongated tubular compartment.

47. An erosion control structure adpated for reducing erosion at a shoreline of a body of water having a bottom and a water surface, comprising:

an elongated mat having longitudinal edges and having peripheral pockets extending along said longitudinal edges and adapted to hold ballast material, said elongated mat having a length substantially greater than the width thereof, said elongated mat adapted to be extended out into said body of water and anchored by said peripheral pockets to the bottom thereof; and an elongated tubular element positioned atop and extending upwardly from said mat, said elongated tubular element having a length substantially greater than the width thereof, said elongated tubular element adapted to be filled with ballast material, and said elongated tubular element width when filled being less than said elongated mat width, whereby when installed said mat and said elongated tubular element are extended out into said body of water to a location beneath said water surface and filled with ballast material.

48. The erosion control structure of claim 47, further comprising:

a plurality of said elongated tubular elements positioned atop said mat and adapted to extend out into said body of water.

49. The erosion control structure of claim 48, wherein:

said elongated tubular elements are secured together laterally adjacent each other.

50. The erosion control structure of claim 49, wherein:

said elongated tubular elements are adapted to be filled with a cementitious material.

* * * * *

UNITED STATES PATENT AND TRADEMARK OFFICE

CERTIFICATE OF CORRECTION

PATENT NO. : 4,690,585

DATED : September 1, 1987

INVENTOR(S) : Dick L. Holmberg

It is certified that error appears in the above-identified patent and that said Letters Patent is hereby corrected as shown below:

Column 3, line 9
"to" should be --or--

Column 3, line 31
"Fig. 4" should be --Fig. 5--

Signed and Sealed this

Tenth Day of August, 1993

*Attest:*

Michael K. Kirk

MICHAEL K. KIRK

*Attesting Officer*

*Acting Commissioner of Patents and Trademarks*